US010046440B1

(12) United States Patent
Colombo et al.

(10) Patent No.: US 10,046,440 B1
(45) Date of Patent: Aug. 14, 2018

(54) SANDING APPARATUS FOR BILLIARD CUE STICKS

(71) Applicants: Keith A. Colombo, Loxahatchee, FL (US); Jeremy G. Brooks, Lake Worth, FL (US)

(72) Inventors: Keith A. Colombo, Loxahatchee, FL (US); Jeremy G. Brooks, Lake Worth, FL (US)

( * ) Notice: Subject to any disclaimer, the term of this patent is extended or adjusted under 35 U.S.C. 154(b) by 107 days.

(21) Appl. No.: 15/368,980

(22) Filed: Dec. 5, 2016

(51) Int. Cl.
*B24D 15/04* (2006.01)
*A63D 15/08* (2006.01)

(52) U.S. Cl.
CPC ..... *B24D 15/04* (2013.01); *A63D 15/08* (2013.01)

(58) Field of Classification Search
CPC ..... B24D 15/04; A63D 15/08
USPC ..... 451/526, 49, 51
See application file for complete search history.

(56) References Cited

U.S. PATENT DOCUMENTS 2,214,515 A * 9/1940 Vanderveer ..... B24D 15/04 451/523
2,595,429 A * 5/1952 Trussell ..... B24D 15/023 451/523
3,621,505 A * 11/1971 Vocker et al. ..... A46B 13/02 15/104.04
3,745,622 A * 7/1973 DeAmicis ..... B23D 71/00 15/104.011
4,785,586 A 11/1988 Kratfel
5,168,663 A * 12/1992 Klocke ..... B24D 15/023 451/514
5,295,278 A * 3/1994 Condon ..... A46B 5/0012 15/104.04
5,522,763 A * 6/1996 Regnier ..... B24D 15/04 451/502
5,564,972 A * 10/1996 Marvin ..... B24B 33/04 451/314
5,759,090 A * 6/1998 Kawate ..... B24B 19/26 451/28
5,887,350 A 3/1999 Porper
6,080,053 A * 6/2000 Marvin ..... B24B 33/04 451/526
6,152,814 A * 11/2000 Amarosa, Sr. ..... B24D 9/02 451/504
6,508,698 B1 * 1/2003 Faas ..... B24B 19/18 451/416
9,427,847 B2 8/2016 Lin
9,949,559 B2 * 4/2018 Rosenblum ..... A46B 9/02

* cited by examiner

*Primary Examiner* — George Nguyen
(74) *Attorney, Agent, or Firm* — Mark D. Bowen; Malin Haley DiMaggio & Bowen, P.A.

(57) ABSTRACT

A sanding and smoothing apparatus for pool cue shafts comprises an elongate resilient main body having generally concentrically disposed resilient radially-inner and radially-outer C-shaped members. The apparatus is sized for mating engagement with the tapered shaft of a pool cue received in close fitting conforming relation with the inner surface of the radially-inner C-shaped member. The inner surface of the radially-inner C-shaped member is provided with a suitable abrasive sanding material, which may comprise a sanding sheet or an abrasive coating.

7 Claims, 6 Drawing Sheets

SANDING APPARATUS FOR BILLIARD CUE STICKS

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention generally relates to cue sports, such as billiards or pool, and more particularly to a sanding apparatus for use with a pool cue stick to smooth the outer surface of the cue so as to minimize friction when executing shots.

2. Description of Related Art

Billiard games are mostly played with a stick known as a cue. The cue stick (or simply cue) typically comprises a one piece tapered stick or a two piece stick wherein the pieces are adapted to be coupled together in the middle, such as by threaded connection. The cue typically includes a butt end, a tapered shaft projecting from the butt end and terminating at a ferrule upon which a rounded tip is affixed for making contact with the ball. A billiard player typically grasps the butt end of the cue with one hand (e.g. with the right hand, for right handed players) and supports the cue shaft by making a bridge with his/her other hand. A bridge is formed by placing a hand on the table and spreading the fingers apart such that the cue can slide between the "V" that is formed between the thumb and index finger, or alternately between index and middle finger knuckles. The billiard player then executes a shot by moving the cue longitudinally relative to the bridge hand with a short jab or thrusting motion.

The smooth movement of the cue across the supporting surfaces of the player's hand is critical in executing precise shots, particularly since the skin of the player's hand is not an ideal sliding surface for a cue. For example, perspiration can cause the player to experience difficulty executing a shot by affecting the ability of the cue to glide smoothly over the skin. In an effort to address this problem, billiard players commonly apply a dry lubricating powder, such as chalk, to their cue support hand. The powder, however, must be repeatedly re-applied and is known to get on the player's clothing, the felt table covering, furniture etc. Another factor effecting the sliding of the cue relates to the smoothness of the outer cue surface. As a result, maintaining a smooth outer surface on the cue is important to minimize frictional resistance.

While specialized devices for sanding and shaping the tip of a pool cue are known in the art, there exists a need for an apparatus specifically designed for sanding and smoothing the tapered outer surface of the cue.

BRIEF SUMMARY OF THE INVENTION

The present invention overcomes the limitations and disadvantages present in the art by providing a sanding and smoothing apparatus for pool cue shafts. A cue shaft sanding apparatus in accordance with the present invention comprises an elongate resilient main body having generally concentrically disposed resilient radially-inner and radially-outer C-shaped members. The apparatus is sized to for mating engagement with the tapered shaft of a pool cue received in close fitting conforming relation with the inner surface of the radially-inner C-shaped members. The inner surface of the radially-inner C-shaped member is provided with a suitable abrasive sanding material, which may comprise a sanding sheet or an abrasive coating. As noted above, the apparatus is sized for hand-held use with the tapered shaft of a pool cue axially received within the inner C-shaped member, whereby the user's hand may apply a suitable compressive force while sliding the sanding apparatus back and forth over the shaft. Periodic sanding and smoothing of the cue stick shaft maintains low static and dynamic coefficients of friction between the cue shaft and the user's hand.

Accordingly, it is an object of the present invention to provide advancements in the art of cue sports.

It is another object of the present invention to improve cue handling by providing sanding apparatus for smoothing and sanding the shaft of a cue stick to provide and maintain a friction a low coefficient of static and dynamic friction.

Yet another object of the present invention is to provide such an accessory that conforms to the tapered shape of the shaft.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control. As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, when a number or a range is recited, ordinary skill in the art understand it intends to encompass an appropriate, reasonable range for the particular field related to the invention.

Turning now to the drawings, the present invention overcomes the limitations and disadvantages present in the art by providing a sanding and smoothing apparatus, generally referenced as 10, for use with pool cue shafts. Sanding apparatus 10 is preferably fabricated from an extruded elastomeric material, such styrene-ethylene/butylene-styrene ("SEBS") polymer, such that the apparatus resumes its original shape when a deforming force is removed.

Figure 1:
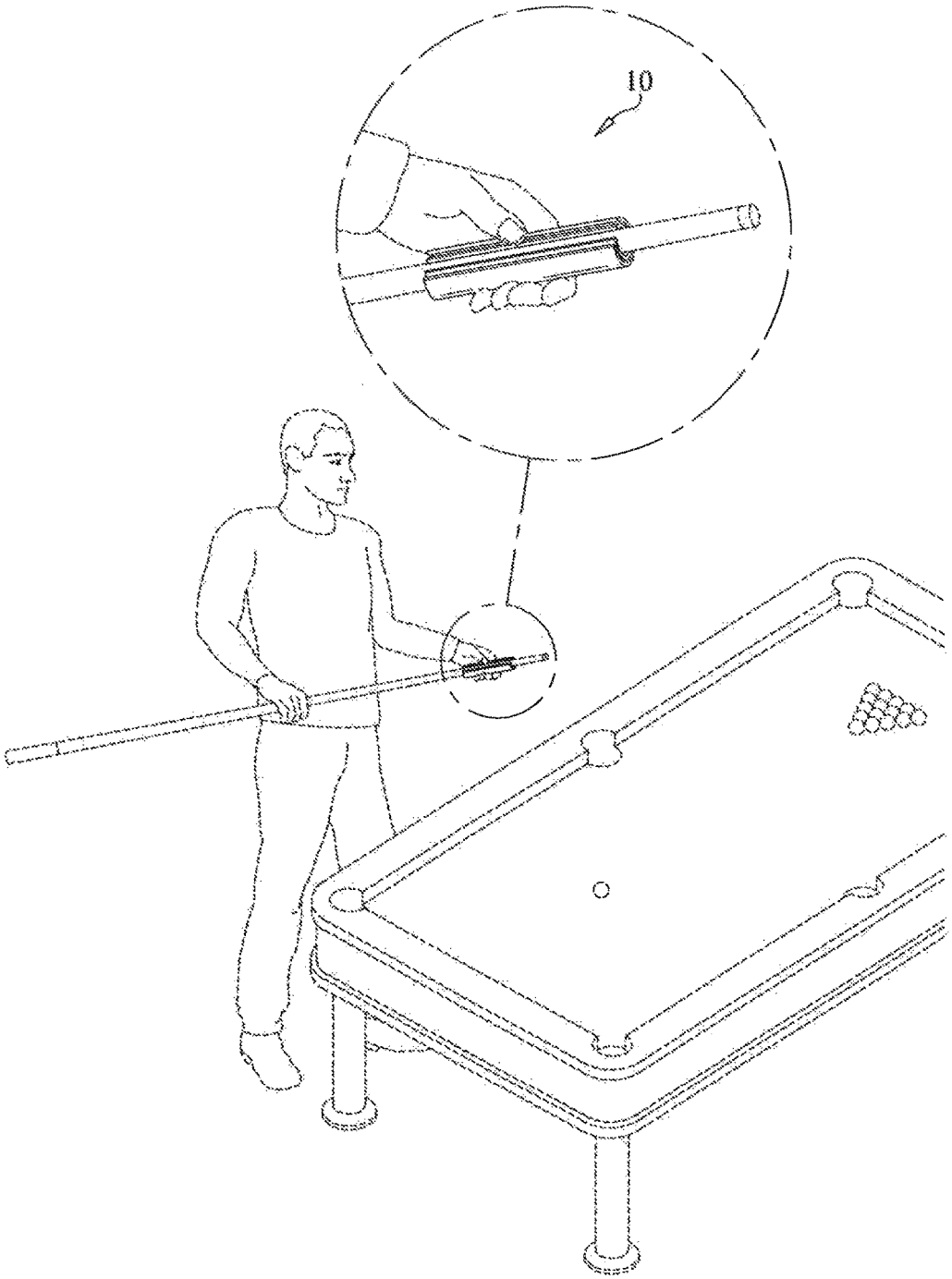
FIG. 1 is a perspective view of a friction-reducing cue stick sleeve sanding apparatus in use by a player in accordance with a preferred embodiment of the present invention.
Figure 2:
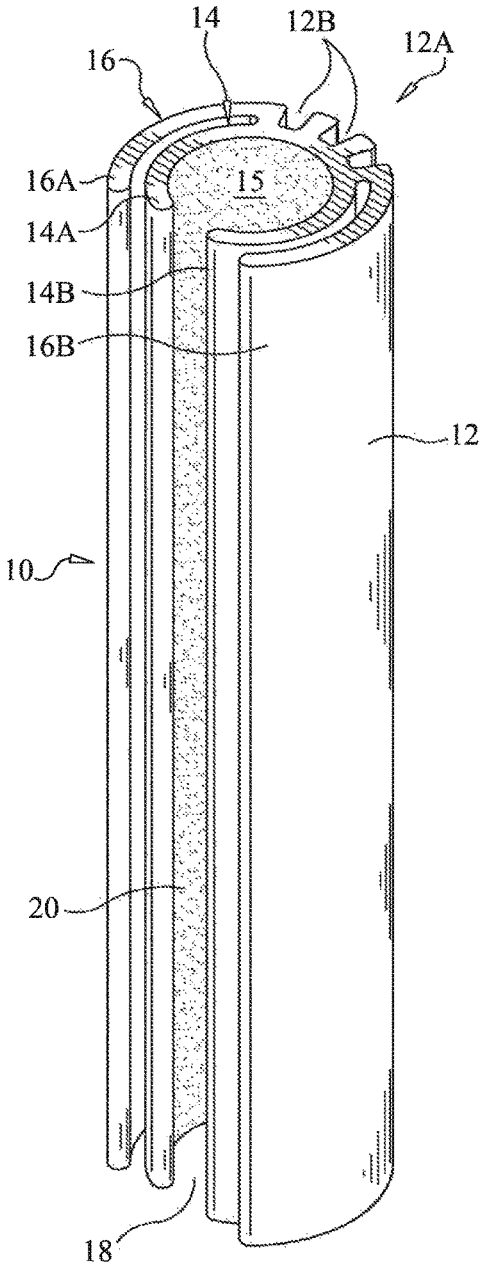
FIG. 2 is a top perspective view of the sanding apparatus.
Figure 3:
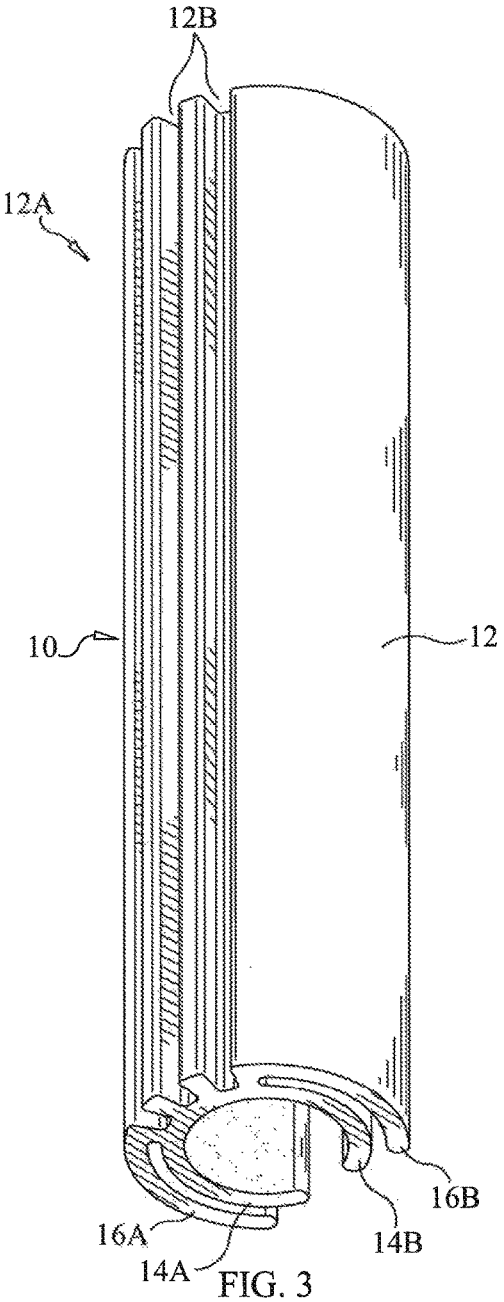
FIG. 3 is a bottom perspective view thereof.
Figure 4:
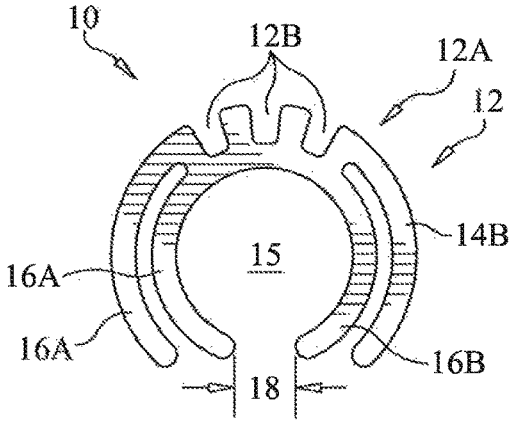
FIG. 4 is an end view thereof.
Figure 5:
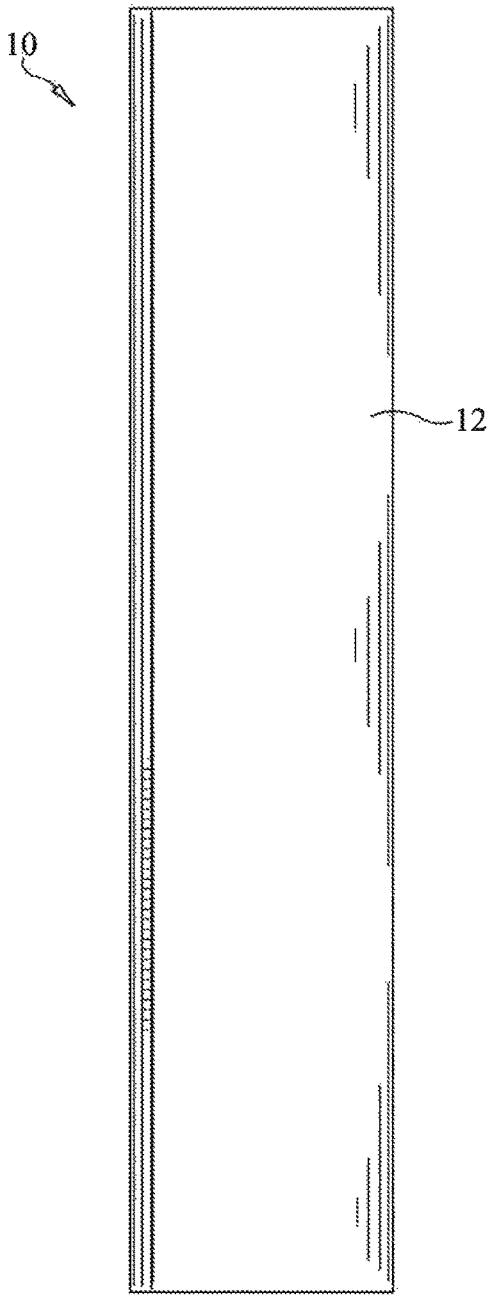
FIG. 5 is a side view thereof.
Figure 6:
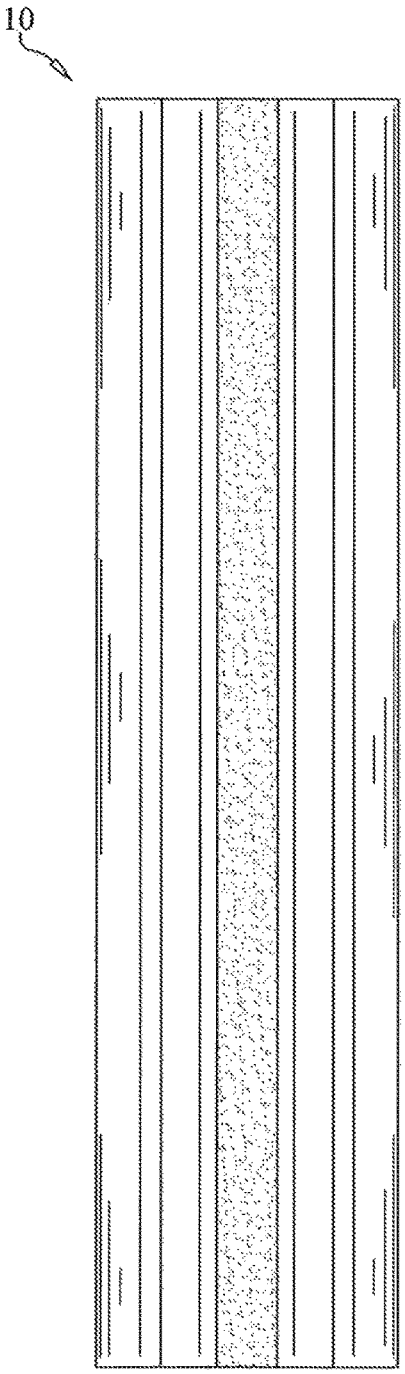
FIG. 6 is a front view thereof.
Figure 7:
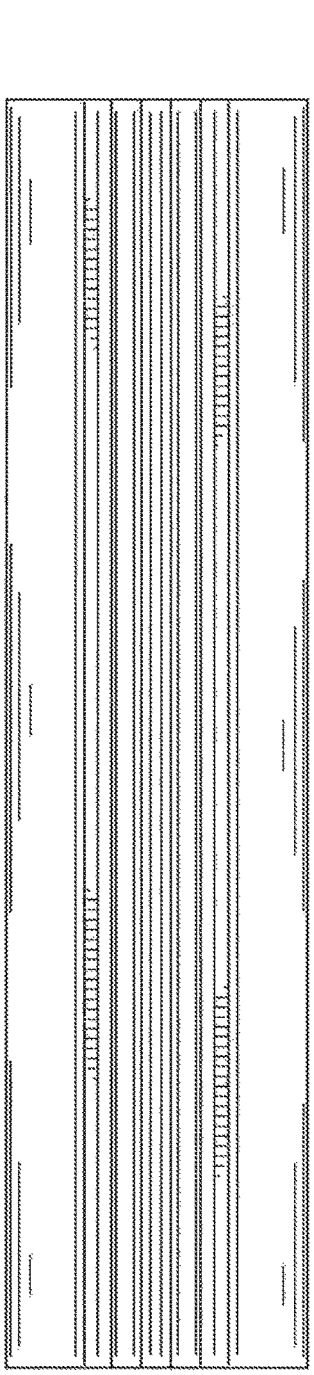
FIG. 7 is a rear view thereof.

Cue stick sanding apparatus 10 comprises an elongate, generally tubular, resilient main body 12 having resilient generally concentrically disposed, and radially spaced, C-shaped members, including a radially inner C-shaped member, generally referenced as 14, and a radially outer C-shaped member, generally referenced as 16. A cue stick receiving chamber 15 is defined within C-shaped member 14. Each C-shaped member (14 and 16) includes a pair of arcuate arms which laterally project from opposing sides of a central spine portion, generally referenced as 12A, of main body 12. Spine portion 12A, preferably defines a plurality of longitudinal grooves 12B, which function to improve compressive flexing and radial expansion of the sanding apparatus. More particularly, radially inner C-shaped member 14 includes arcuate arms 14A and 14B, and radially outer C-shaped member 16 includes arcuate arms 16A and 16B. As illustrated in FIG. 2, a gap 18 is defined between the terminal ends of arms 14A, 14B, 16A, and 16B. Gap 18 provides a space that allows sanding apparatus 10 to be removably mated to a cue stick by insertion of the cue stick through gap 18 into the operative position seen in FIG. 1.

Figure 8:
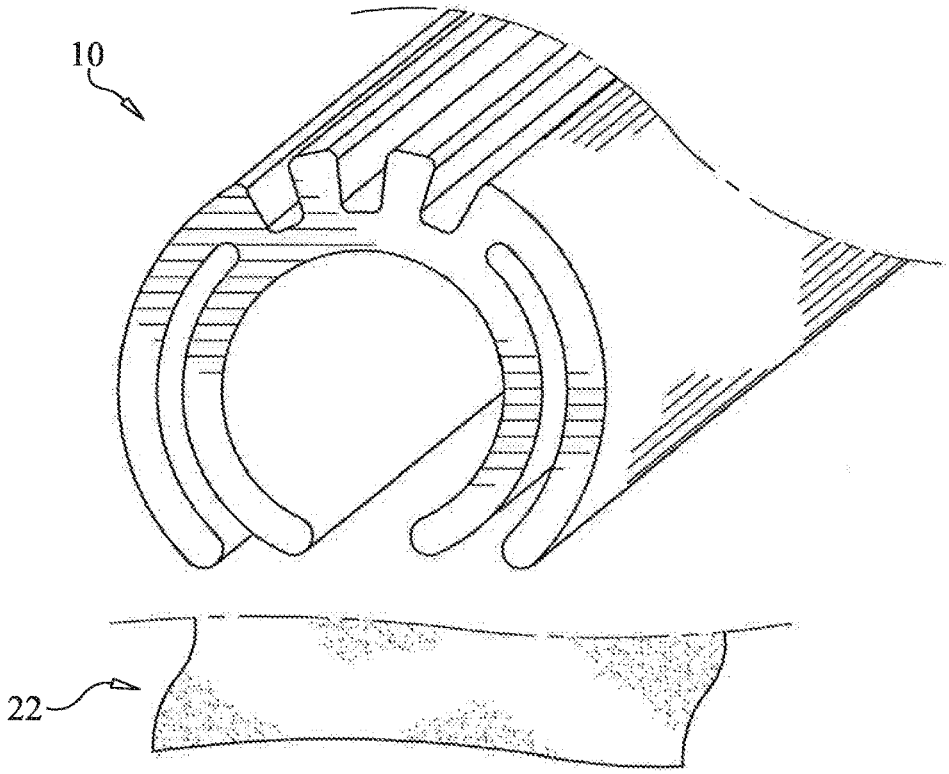
FIG. 8 is a partial end perspective view illustrating the sanding apparatus along with a sheet of sandpaper separated from the sanding apparatus.
Figure 9:
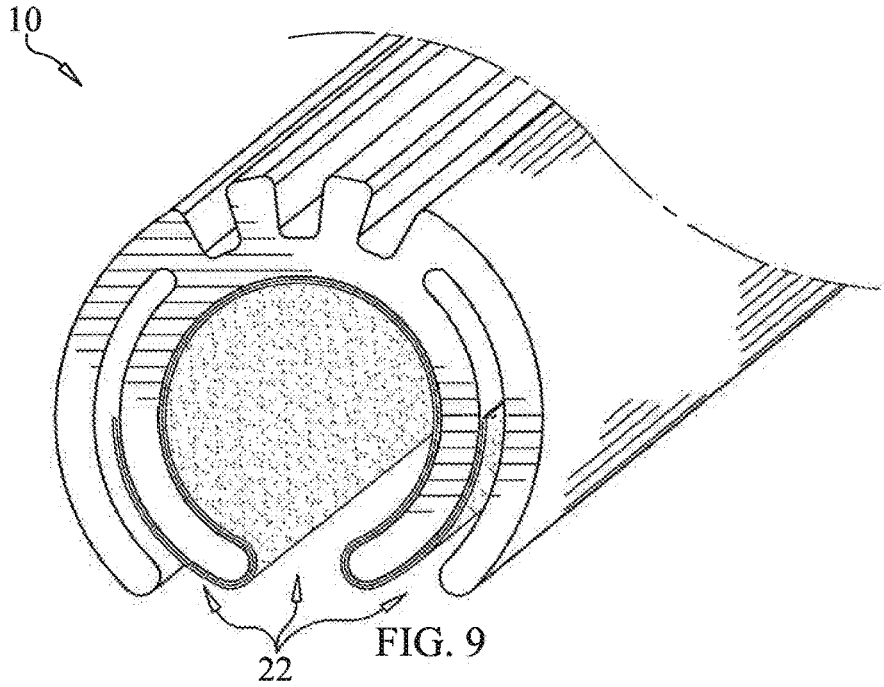
FIG. 9 is a partial end perspective view thereof with the sandpaper installed in operative relation with the sanding apparatus.

A significant aspect of the present invention involves providing the inner surface of C-shaped member 14 with an abrasive material 20 which facilitates the sanding and/or smoothing of the cue stick surface when in use. Abrasive material 20 may be provided as a layer of sheet-like material (e.g. sand paper sheet) which may be removable and replaceable. FIG. 8 illustrates sanding apparatus 10 alongside a sheet of sandpaper 22. Sandpaper 22 is installed in operative relation on apparatus 10 by insertion of the sandpaper through gap 18 into the chamber 15 of apparatus 10 and inserting the lateral edges of the sandpaper disposed between arm 14A and 16A, and 14B and 16B as illustrated in FIG. 9. As should be apparent, the sandpaper sheet 22 may be removed and replaced as necessary. In an alternate embodiment, abrasive material may comprise a coating applied during the manufacturing process, wherein the coating is permanently affixed and contains abrasive particles, such as silica. In yet another embodiment, the elastomeric material used in the extrusion process may have abrasive particles embedded therein.

Cue stick sanding apparatus 10 functions to smooth and/or sand a cue stick so as to form and maintain a smooth surface which maximizes shot accuracy by minimizing friction between the stick and the user's hand. More particularly, cue stick sanding apparatus 10 is sized to for mating engagement with the tapered shaft of a pool cue received within chamber 15 in close fitting conforming relation with the inner surface of radially-inner C-shaped member 14. Due to the resilient nature of the elastomeric material used to form the apparatus, C-shaped members 14 and 16, and particularly the arcuate arms thereof (14A, 14B, 16A, and 16B) flex into conforming engagement with the exterior surface of the tapered pool cue shaft. Since the inner surface of the radially-inner C-shaped member is provided with a suitable abrasive sanding material 20, sliding the sanding apparatus back and forth along the cue stick while applying compressive pressure results in smoothing of the cue stick outer surface while also removing oil, and debris. Periodic sanding and smoothing of the cue stick shaft maintains low static and dynamic coefficients of friction between the cue shaft and the user's hand.

Figure 10:
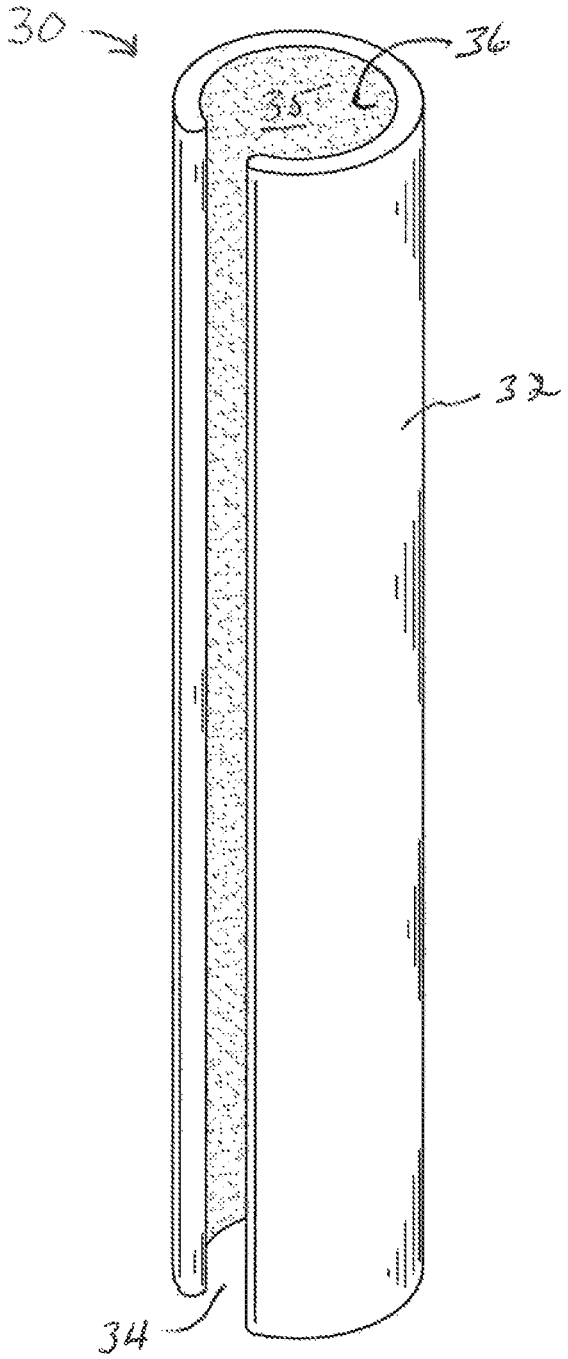
FIG. 10 is an alternate embodiment sanding apparatus.

FIG. 10 illustrates an alternate embodiment cue stick sanding apparatus, generally referenced as 30. Sanding apparatus 30 comprises an elongate, generally C-shaped main body 32, preferably fabricated by extrusion from a resilient material. C-shaped main body 32 defines a longitudinal slot or gap 34 defined between the terminal ends of the arcuate arms forming the C-shape. As with the previously disclosed embodiment, gap 34 allows for insertion of a cue stick (not shown) into the cue stick receiving chamber 35 which is primarily bounded by the inner surface 36 of main body 32. In this embodiment, sanding apparatus 30, and particularly the inner surface 35 of main body 32 includes an abrasive material, illustrated as stippling in FIG. 10. The abrasive material may comprise an applied coating, wherein the coating is permanently affixed and contains abrasive particles, such as silica. In yet another embodiment, the elastomeric material used in the extrusion process may have abrasive particles embedded therein. Finally, a sheet of sandpaper may be removably affixed to surface 36 using an adhesive.

The foregoing is considered as illustrative only of the principles of the invention. Further, since numerous modifications and changes will readily occur to those skilled in the art it is not desired to limit the invention to the exact construction and operation shown and described, and accordingly, all suitable modifications and equivalents may be resorted to, falling within the scope of the invention. The instant invention has been shown and described herein in what is considered to be the most practical and preferred embodiment. It is recognized, however, that departures may be made therefrom within the scope of the invention and that obvious modifications will occur to a person skilled in the art.

What we claim is:

1. A cue stick sanding device comprising:

an elongate main body having a longitudinal spine and concentrically disposed, radially spaced, arcuate arms, including a pair of radially inner arcuate arms and a pair of concentrically disposed radially outer arcuate arms, projecting from said spine;

a longitudinal gap defined between terminal ends of said arms, and a cue stick receiving chamber bounded by inner surfaces of said spine and said radially inner arms;

an abrasive material disposed within said chamber, whereby sliding the sanding apparatus back and forth along the cue stick results in smoothing of the cue stick outer surface.

2. The cue stick sanding device according to claim 1 wherein said abrasive material comprises a sheet of sandpaper, said sheet having opposing lateral edges disposed between said radially inner and radially outer arms.

3. The cue stick sanding device according to claim 1, wherein said abrasive material comprises a coating applied to an inner surface of said radially inner arms.

4. The cue stick sanding device according to claim 1, further including a plurality of longitudinal grooves defined on an exterior surface of said spine.

5. A cue stick sanding device comprising:

an elongate main body having a longitudinal spine and concentrically disposed, radially spaced, arcuate arms projecting from said spine, said arms including a pair of radially inner arcuate arms and a pair of concentrically disposed radially outer arcuate arms;

a longitudinal gap defined between terminal ends of said radially inner arms, and a cue stick receiving chamber bounded by inner surfaces of said spine and said radially inner arms;

a sheet of sandpaper removably disposed within said chamber with lateral edges of said sandpaper disposed between said radially inner and radially outer arms;

whereby sliding the sanding apparatus back and forth along the cue stick results in smoothing of the cue stick outer surface.

6. The cue stick sanding device according to claim 5, wherein said main body is formed of a resilient material.

7. The cue stick sanding device according to claim 6, further including at least one longitudinal groove defined on the outer surface of the spine of said main body.

* * * * *